US011920425B2

(12) United States Patent
Al-Dossary et al.

(10) Patent No.: US 11,920,425 B2
(45) Date of Patent: Mar. 5, 2024

(54) INTELLIGENT DETECT, PUNCH, ISOLATE, AND SQUEEZE SYSTEM

(71) Applicant: SAUDI ARABIAN OIL COMPANY, Dhahran (SA)

(72) Inventors: Mohammed Jaber Al-Dossary, Dammam (SA); Mohammed Y. Al Daif, Al Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 38 days.

(21) Appl. No.: 17/651,370

(22) Filed: Feb. 16, 2022

(65) Prior Publication Data

US 2023/0258053 A1 Aug. 17, 2023

(51) Int. Cl.
*E21B 33/14* (2006.01)
*E21B 23/06* (2006.01)
*E21B 43/112* (2006.01)

(52) U.S. Cl.
CPC ..... *E21B 33/14* (2013.01); *E21B 23/06* (2013.01); *E21B 43/112* (2013.01)

(58) Field of Classification Search
CPC ..... E21B 33/12
See application file for complete search history.

(56) References Cited

U.S. PATENT DOCUMENTS

| | | | | |
|---|---|---|---|---|
| 2,381,929 | A | 8/1945 | Schlumberger | |
| 3,414,071 | A | 12/1968 | Alberts | |
| 5,467,819 | A | 11/1995 | Braddick | |
| 5,474,126 | A | 12/1995 | Lynde et al. | |
| 5,549,163 | A | 8/1996 | Sieber | |
| 5,678,634 | A | 10/1997 | Rehbock et al. | |
| 6,173,606 | B1 * | 1/2001 | Mosley | G01V 1/46 73/152.16 |
| 8,136,584 | B2 | 3/2012 | Burnett et al. | |
| 9,506,333 | B2 | 11/2016 | Castillo et al. | |
| 2002/0148611 | A1 | 10/2002 | Williger et al. | |
| 2004/0108739 | A1 | 6/2004 | Beeman et al. | |

(Continued)

FOREIGN PATENT DOCUMENTS

| | | | |
|---|---|---|---|
| RU | 2731357 | C1 | 9/2020 |
| WO | 2015192202 | A1 | 12/2015 |
| WO | 2022182444 | A1 | 9/2022 |

OTHER PUBLICATIONS

Denmon et al.; "Single-Trip Abandonment Approach", OTC-26638-MS; Offshore Technology Conference; Mar. 22, 2016; pp. 1-11 (11 pages).

*Primary Examiner* — William D Hutton, Jr.
*Assistant Examiner* — Aci T Skaist
(74) *Attorney, Agent, or Firm* — Osha Bergman Watanabe & Burton LLP

(57) ABSTRACT

A method includes running a wired tubing having perforating arms, a packer, and a scanner into a casing string having an annulus. A portion of the annulus that is void of cement is determined using the scanner. The packer is activated to isolate a downhole section of the casing string from an up-hole section of the casing string. A plurality of holes are punched in the up-hole section of the casing string by ejecting the perforating arms from the wired tubing. The annulus of the casing string is cemented by pumping cement through the plurality of holes into the portion of the annulus void of cement.

20 Claims, 4 Drawing Sheets

(56) References Cited

U.S. PATENT DOCUMENTS

| | | | | |
|---|---|---|---|---|
| 2009/0301720 | A1* | 12/2009 | Edwards | E21B 33/146 166/120 |
| 2015/0136398 | A1 | 5/2015 | Armstrong et al. | |
| 2015/0198009 | A1* | 7/2015 | Bexte | E21B 29/002 166/290 |
| 2020/0056446 | A1 | 2/2020 | Al-Mousa et al. | |
| 2020/0102815 | A1* | 4/2020 | Hrupp | E21B 43/119 |
| 2020/0232300 | A1 | 7/2020 | Hess et al. | |
| 2022/0389796 | A1* | 12/2022 | Low | E21B 43/112 |

* cited by examiner

INTELLIGENT DETECT, PUNCH, ISOLATE, AND SQUEEZE SYSTEM

BACKGROUND

In the petroleum industry, hydrocarbons are located in porous reservoirs far beneath the Earth's surface. Wells are drilled into these reservoirs to access and produce the hydrocarbons. Drilling a well includes running and cementing casing into the wellbore to isolate formation fluids and provide the mechanical structure of the well. In some cases, a cement job may "fail" resulting in a portion of the annulus that was supposed to be cemented being void of cement. Or, when a well is undergoing a workover operation, a loss of cement behind the casing may be present. When these situations arise, a cement remediation job may be run. There are various types of cement remediation techniques including, for example, top jobs and perforation ("perf") and squeeze jobs.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for cementing an annulus of a casing string. The method includes running a wired tubing having perforating arms, a packer, and a scanner into the casing string. A portion of the annulus that is void of cement is determined using the scanner. The packer is activated to isolate a downhole section of the casing string from an up-hole section of the casing string. A plurality of holes are punched in the up-hole section of the casing string by ejecting the perforating arms from the wired tubing. Finally, the annulus of the casing string is cemented by pumping cement through the plurality of holes into the portion of the annulus void of cement.

The system includes a wired tubing, a scanner, a packer, and perforating arms. The wired tubing is disposed within the casing string. The scanner is electronically and physically connected to the wired tubing. The scanner is configured to detect a portion of the annulus that is void of cement. The packer has an unexpanded position and an expanded position and is connected to the wired tubing. The perforating arms have an ejected position and a retracted position and are connected to the wired tubing. A plurality of holes in the casing string are created by the perforating arms moving from the retracted position to the ejected position. The system further includes cement configured to be pumped from a surface location, through a conduit of the wired tubing, and into the portion of the annulus that is void of cement using the plurality of holes.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
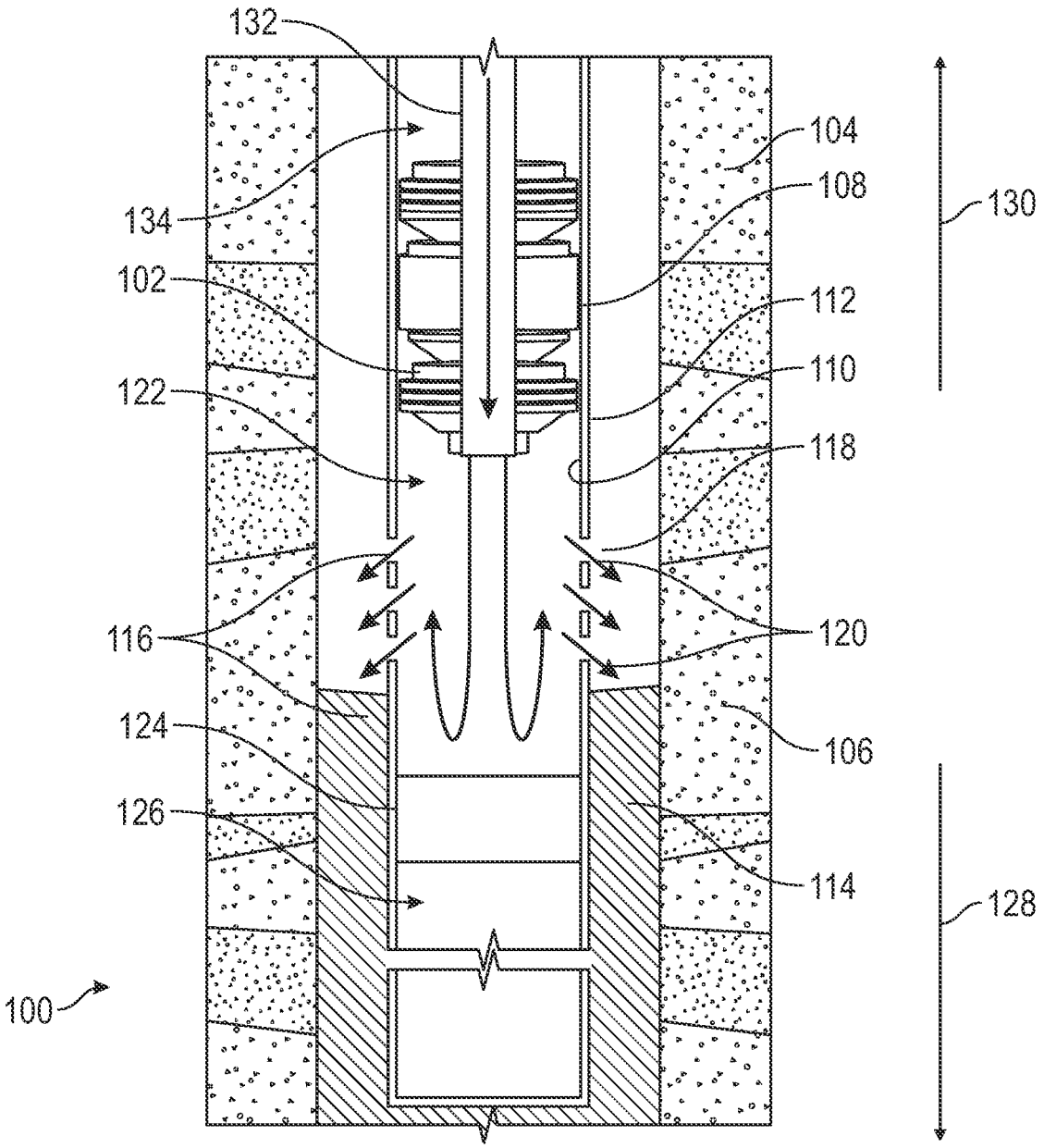
FIG. 1 shows a well undergoing a conventional perf and squeeze operation in accordance with one or more embodiments of the disclosure.

FIG. 1 shows a well (100) undergoing a conventional perf and squeeze operation in accordance with one or more embodiments of the disclosure. Specifically, FIG. 1 shows a wellbore (104) that has been drilled into a formation (106). A casing string (108) has been set in the wellbore (104). The casing string (108) has an inner surface (110) and an outer surface (112). The casing string (108) is a string of large-diameter pipe threaded, or elsewise connected, together. The large-diameter pipe may be made of a material that can withstand wellbore (104) pressures and temperatures, such as steel.

An annulus (114) is formed between the outer surface (112) of the casing string (108) and the wellbore (104). As a result of a prior cement job, the annulus is mostly filled with existing cement (116). However, in this example, a portion (118) of the annulus (114) is void of the existing cement (116). Herein, the term "void" may be defined as completely or partially empty. The well (100) depicted in FIG. 1 may represent a well (100) that is in the process of being drilled and completed or a well (100) that has been put on production and is undergoing a workover operation.

A cementing operation employing a cement retainer is shown being run on the well to fill the portion (118) of the annulus (114) with cement (116). Prior to the cementing operation beginning, a cement evaluation log must be run on the well (100) to determine the location of the portion (118) void of cement (116). The cement evaluation log is performed by running a cement bond logging tool on wireline into the well (100). The cement bond logging tool may be any tool known in the art such as slim-array sonic logging tool, a slimXtreme sonic logging tool, a digital sonic logging tool, etc. The cement bond logging tool is pulled from the well (100) and the location of the portion (118) void of cement is determined.

After, the cement evaluation log is performed, the perforation operation may begin. The perforation operation includes running a perforating gun into the well (100) to leave perforations (120) in a first segment (122) of the casing string (108) adjacent the portion (118) void of cement (116). The perforations (120) place the first segment (122) of the casing string (108) in fluid communication with the portion (118) void of cement (116). The perforation operation may be conducted according to any method known in the art, such as running a perforation gun into the hole, on wireline, and detonating the explosives to create the perforations in the casing string (108).

After the perforation operation is performed, a plug (124) is set within the casing string (108). The plug (124) is set by tripping the plug (124) into the well (100) on wireline or on drill pipe. The plug (124) may be any type of plug (124) known in the art, such as a bridge plug (124). The plug (124) isolates a second segment (126) of the casing string (108), located downhole (128) of the plug (124), from the first segment (122) of the casing string (108) located up hole (130) of the plug (124). Herein, up hole (130) is defined as a location or direction within the ground and towards the surface of the Earth, and downhole (128) is defined as a location or direction within the ground and away from the surface of the Earth. Both up hole (130) and downhole (128) are represented by arrows in FIG. 1.

In the embodiment shown in FIG. 1, a cement retainer (102) has been run and set in the casing string (108) so as to form a seal against the inner surface (110) of the casing string (108). The cement retainer (102) is run into the casing string (108) using a tubing string (132). The tubing string (132) is a string of smaller-diameter pipe made of a material that can withstand downhole pressures and temperatures, such as steel. The tubing string (132) may be drill pipe or any other type of pipe having a conduit that may supply cement (116) downhole (128). The tubing string (132) has a connecting device, for example a stinger, that connects and provides fluid communication between the tubing string (132) and the cement retainer (102).

The cement retainer (102) is adapted to be mounted in the casing string (108). The cement retainer (102) may be any cement retainer (102) known in the art that has the ability to isolate the first segment (122) of the casing string (108) from a third segment (134) of the casing string (108) and deliver cement (116) to the first segment (122). The cement retainer (102) is shown disposed and set within the casing string (108) to isolate the first segment (122), located downhole (128) from the cement retainer (102), from the third segment (134) of the casing string (108), located up hole (130) from the cement retainer (102).

FIG. 1 shows cement (116) being forward circulated in the well (100). Forward circulation is when the fluid is pumped in the downhole (128) direction through the inside of the tubing string (132) and pushed in the up hole (130) direction through the space between the tubing string (132) and the casing string (108). The cement (116) is shown being forward circulated from a surface location (i.e., a location located along the Earth's surface), downhole (128) through the tubing string (132), through the cement retainer (102), and into the first segment (122).

Once the first segment (122) has been filled with cement (116), the cement (116) enters the portion (118) of the annulus (114) through the perforations (120). After the required volume of cement (116) is pumped through the tubing string (132), the tubing string (132) disconnects and pulls out of the cement retainer (102). A fluid, such as drilling mud, is reverse circulated into the third segment (134) of the casing string (108) to remove the cement (116) from the inside of the tubing string (132).

Reverse circulation is when the fluid is pumped in the downhole (128) direction into the casing string (108) and around the outside of the tubing string (132). The pressure of the fluid being pumped pushes the fluid in the up hole (130) direction through the inside of the tubing string (132). The cement (116) that was left inside of the tubing string (132), after completion of the cement (116) placement in the portion (118) of the annulus (114), returns to the surface through the inside of the tubing string (132) and is followed by the fluid. Once all the left-over cement (116) has been returned to the surface, the tubing string (132) may be pulled out of the casing string (108), and the perf and squeeze job is complete.

Conventional perf and squeeze operations, as described above, require multiple trips into the well (100) to perform the logging, perforating, plugging, and pumping operations. This is time consuming and poses safety risks. A major safety risk occurs after the casing string (108) has been perforated. After the casing string (108) is perforated, there is a time period where the well (100) could experience drilling fluid losses to the annulus (114) and with no work string located in the well (100) to mitigate said losses. As such, embodiments disclosed herein present alternative systems and methods that combine the logging, perforating, plugging, and pumping operations into tool that only needs to be tripped into the well (100) one time to perform these operations.

FIGS. 2*a*-2*d* show an intelligent detect, punch, isolate, and squeeze (i-DPIS) system (200) run on a well (100) having a portion (118) of an annulus (114) void of cement (116) in accordance with one or more embodiments. Components shown in FIGS. 2*a*-2*d* that are the same as or similar to components shown in FIG. 1 have not been redescribed for purposes of readability and have the same purpose and description as outlined above.

The i-DPIS system (200) includes a wired tubing (202), a scanner (204), a packer (206), and perforating arms (208). FIG. 2*a* shows the i-DPIS system (200) deployed in the well (100) during the logging operation. That is, the scanner (204) is being used to determine the location of the portion (118) of the annulus (114) that is void of cement (116).

Figure 2B:
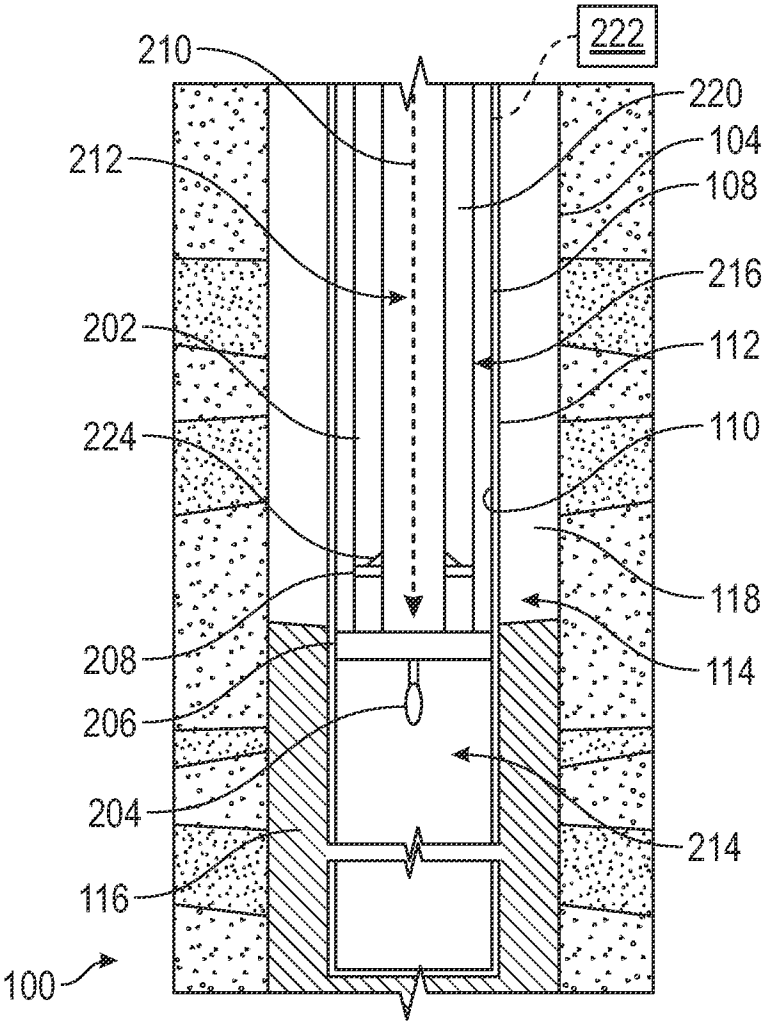
FIGS. 2*a*-2*d* show an intelligent detect, punch, isolate, and squeeze (i-DPIS) system run on a well having a portion of an annulus void of cement in accordance with one or more embodiments.
Figure 2A:
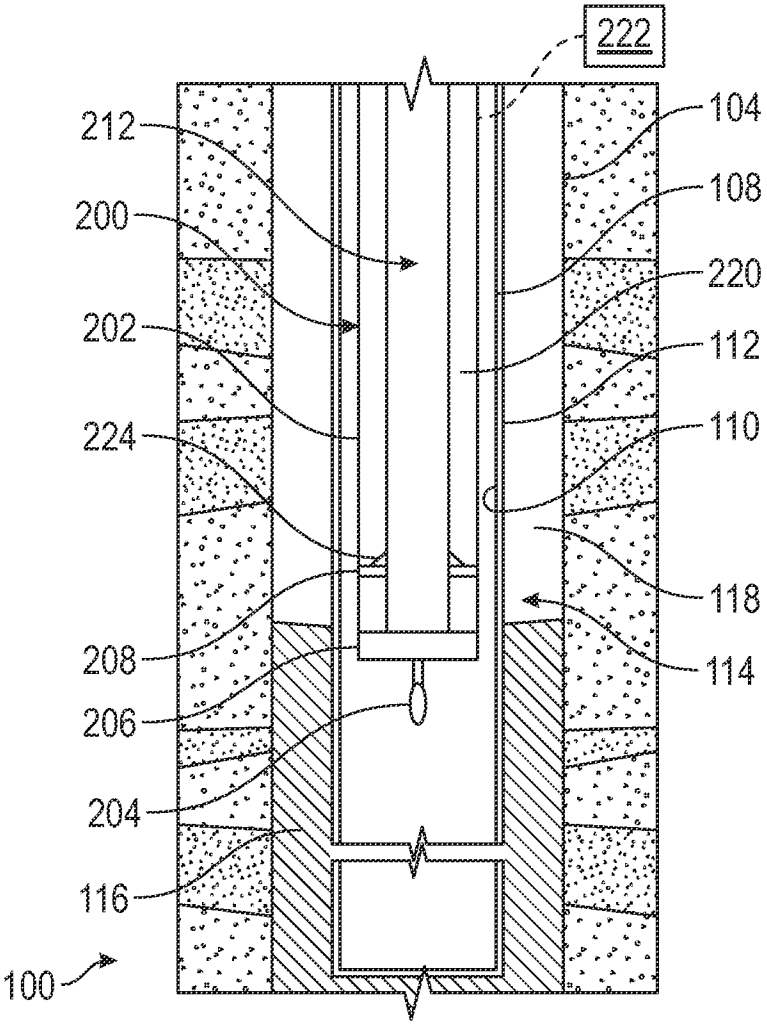

FIG. 2*b* shows the i-DPIS system (200) during the plugging operation. After the portion (118) of the annulus (114) that is void of cement (116) is determined by the logging operation, the packer (206) is activated. The packer (206) is activated by pumping a fluid (210) into a conduit (212) of the wired tubing (202) and applying a first pressure by the fluid (210) on the packer (206). Once activate, the packer (206) isolates a downhole section (214) of the casing string (108) from an up-hole section (216) of the casing string (108). The i-DPIS system (200) is located in the up-hole section (216) of the casing string (108).

Figure 2D:
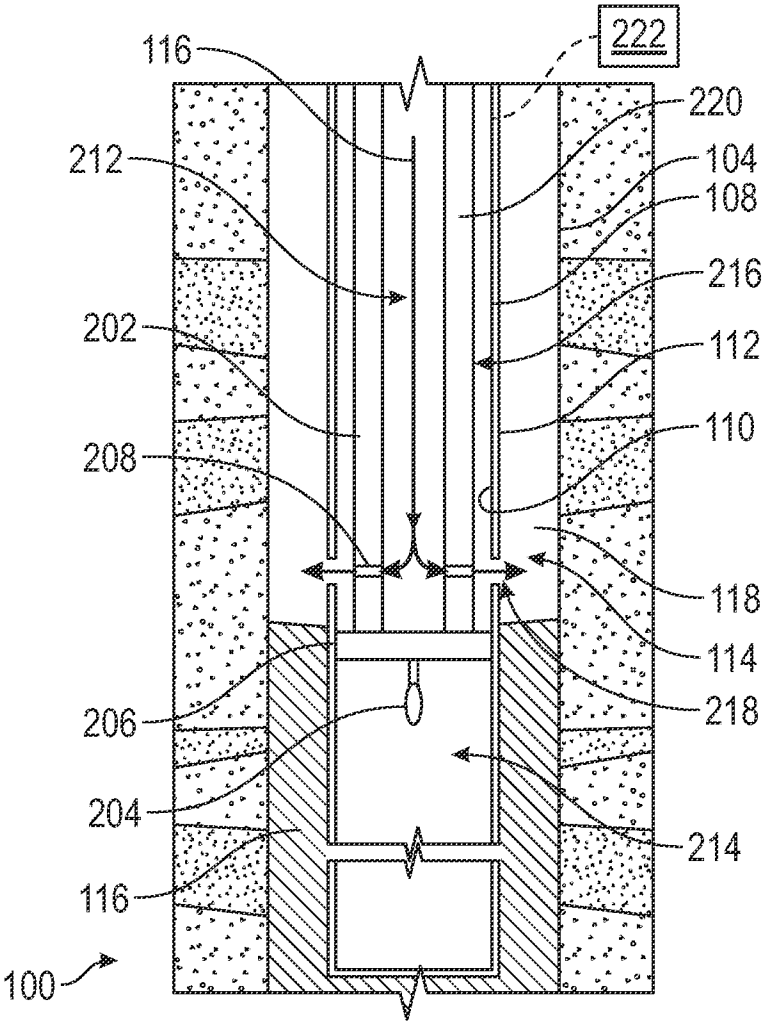
Figure 2C:
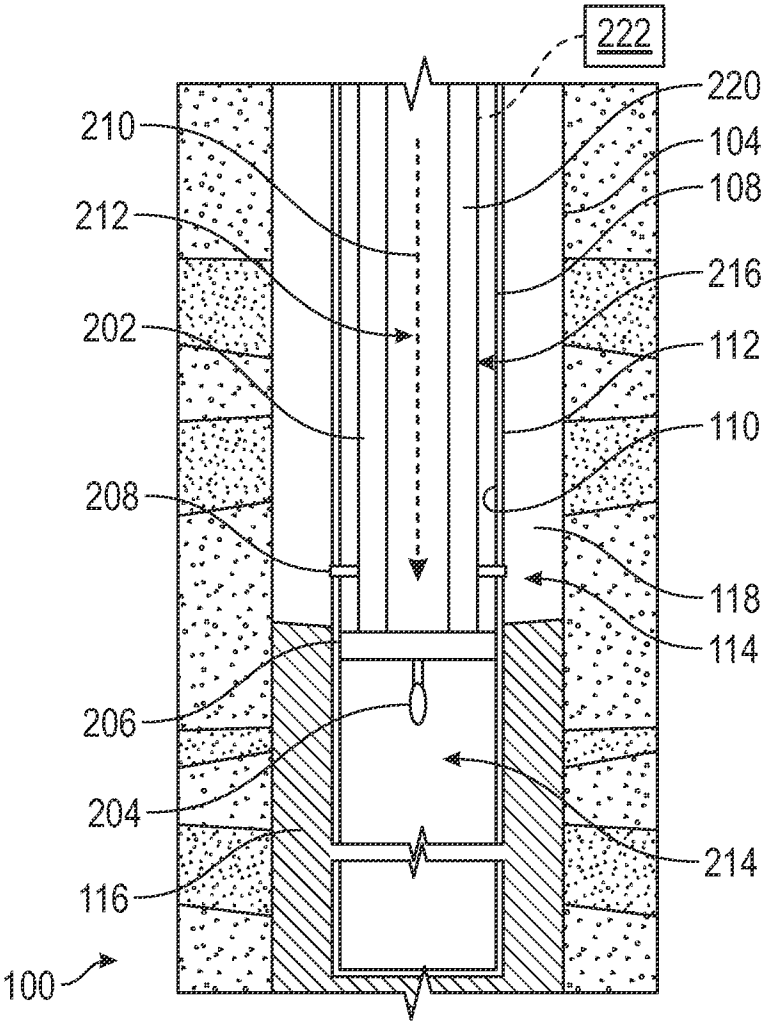

FIG. 2*c* shows the i-DPIS system (200) during the perforating operation. The perforating arms (208) have been ejected from the wired tubing (202) using a second pressure applied by the fluid (210). The second pressure is greater than the first pressure. The ejection of the perforating arms (208) from the wired tubing (202) have caused the perforating arms (208) to perforate the casing string (108) and create a plurality of holes (218).

FIG. 2*d* shows the i-DPIS system (200) during the cementing operation. That is, the perforating arms (208) have been retracted and cement (116) is being pumped into the annulus (114) from a surface location using the wired tubing (202). The operations shown in FIGS. 2*a*-2*d* may all be performed during a single trip of the i-DPIS system (200). That is, the i-DPIS system (200) is able to stay inside of the casing string (108) without having to be brought to the surface location to change out equipment.

In accordance with one or more embodiments, the wired tubing (202) is disposed within the casing string (108) of the well (100). The wired tubing (202) is a tubular shape having a body (220) defining a conduit (212) extending therein. The wired tubing (202) is made out of a plurality of joints of pipe threaded together using pin and box end connections. The pipe is made out of a durable material that can withstand downhole conditions, such as a steel alloy. The pipe is modified to accommodate an inductive coil embedded in the shoulder of the both the pin end and the box end. The coils are connected via an armored high-strength data cable embedded inside the length of each joint of pipe. The inductive coils and the data cables allow electronic signals and data to be transferred from equipment connected to the wired tubing (202) downhole, to a computer processor (222) located at a surface location.

The scanner (204) is physically and electronically connected to the wired tubing (202). The scanner (204) is configured to detect the portion (118) of the annulus (114) that is void of cement (116). The scanner (204) may be directly connected to the wired tubing (202) or may hang downhole from the wired tubing (202) on an electronically conductive material, such as wireline. The scanner (204) detects the portion (118) of the annulus that is void of cement (116) by sending a plurality of signals to the computer processor (222) using the wired tubing (202).

The signals are received by the computer processor (222) and are analyzed at the surface location by a person, or a computer program stored on the computer processor (222), to determine where there is a lack of cement (116) in the annulus (114). In accordance with one or more embodiments, the scanner (204) is a cement bond logging tool such as a slim-array sonic logging tool, a slimXtreme sonic logging tool, a digital sonic logging tool, etc. The signals sent to the computer processor (222) by the cement bond logging tool create a cement bond log that can be analyzed by a person, or a program stored on the computer processor (222), to determine the portion (118) of the annulus (114) that is void of cement (116).

The packer (206) is a piece of equipment that isolates and contains fluids and pressures within a tubing string, such as the casing string (108). The packer (206) is connected to the downhole-most end of the wired tubing (202). The packer (206) is located between the wired tubing (202) and the scanner (204). The packer (206) may be any packer known in the art such as a tension packer, a compression packer, a wireline-set tubing-retrievable packer, a tension/compression set packer, a hydraulic-set packer, etc.

In accordance with one or more embodiments, the packer (206) is a hydraulic-set packer having an unexpanded position and an expanded position. FIG. 2*a* shows the packer (206) in the unexpanded position, and FIGS. 2*b*-2*d* show the packer (206) in the expanded position. The packer (206) moves from the unexpanded position to the expanded position by application of the first pressure on the packer (206) using the fluid (210). The packer (206), in the expanded position, isolates the downhole section (214) of the casing string (108) from the up-hole section (216) of the casing string (108). In accordance with one or more embodiments, the packer (206) is set at a location just downhole from the portion (118) of the annulus void of cement (116).

The perforating arms (208) are connected to the wired tubing (202) and have an ejected position and a retracted position. FIGS. 2*a*, 2*b*, and 2*d* sows the perforating arms (208) in the retracted position and FIG. 2*c* shows the perforating arms (208) in the ejected position. The retracted position is when the perforating arms (208) are located within the body (220) of the wired tubing (202). The perforating arms (208) may extend from the body (220) of the wired tubing (202) into the conduit (212) without departing from the scope of the disclosure herein. The ejected position is when the perforating arms (208) extend away from the wired tubing (202) towards the casing string (108).

In FIGS. 2*a* and 2*b*, the perforating arms (208) are held within the body (220) of the wired tubing (202) using a plurality of shear pins (224). The shear pins (224) are configured to be broken by a predetermined pressure. When the shear pins (224) break, the perforating arms (208) are able to move from the retracted position to the ejected position. The design and the number of shear pins (224) effect the pressure at which the shear pins (224) will need to be exposed to in order to break. Further, the perforating arms (208) have a plurality of springs, not pictured, that enable the perforating arms (208) to be ejected from the wired tubing (202) and allow the perforating arms (208) to perforate, or punch, the casing string (108) to create the plurality of holes (218) in the casing string (108).

The material make-up of the perforating arms (208) is determined based on the material of the casing string (108) that needs to be perforated. For example, the material that makes up the perforating arms (208) needs to be stronger and harder than the material that makes up the casing string (108). Further, the material cannot be brittle. In accordance with one or more embodiments, the shear pins (224) are hydraulically connected to the conduit (212). The shear pins (224) are designed to break under a second pressure applied by the fluid (210). The second pressure is larger than the first pressure used to activate the packer (206) so that the packer (206) will be activated prior to the ejection of the perforating arms (208).

The perforating arms (208) are retrieved back into the wired tubing (202), after the holes (218) are created, by applying a weight on the wired tubing (202) from the surface location. This downhole application of weight will cause the perforating arms (208) to bend against the casing string (108) which will trigger the perforating arms (208) to be retrieved back in the wired tubing (202), as shown in FIG. 2*d*. As the shear pins (224) are broken at this point, the perforating arms (208) may be held within the wired tubing (202) using a locking mechanism, not pictured. In accordance with one or more embodiments, there are three perforating arms (208) radially located 120 degrees apart around the wired tubing (202). In other embodiments, there are four perforating arms (208) radially located 90 degrees apart around the wired tubing (202).

In further embodiments, the perforating arms (208) are hollow and hydraulically connected to the conduit (212) of the wired tubing (202) and the annulus (114) of the casing string (108) through the plurality of holes (218) and after the shear pins (224) are broken. This allows the cement (116) to be pumped from the surface location, through the conduit (212) of the wired tubing (202), out of the perforating arms (208), through the holes (218) in the casing string (108), and into the portion (118) of the annulus (114) that is void of cement (116).

Figure 3:
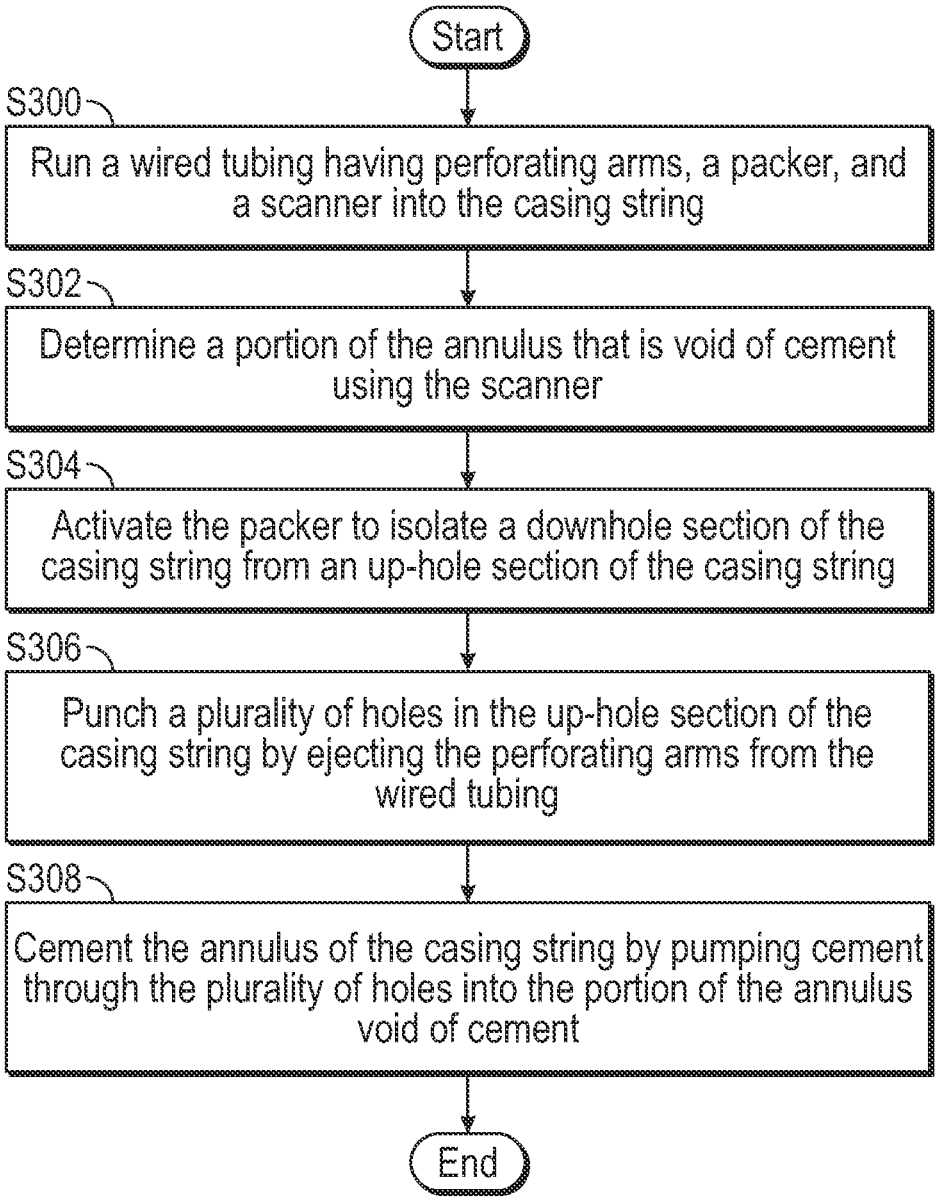
FIG. 3 shows a flowchart in accordance with one or more embodiments.

FIG. 3 shows a flowchart in accordance with one or more embodiments. The flowchart outlines a method for cementing an annulus (114) of a casing string (108). While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, an i-DPIS system (200) made of a wired tubing (202) having perforating arms (208), a packer (206), and a scanner (204) is run into the casing string (108) (S300). A portion (118) of the annulus (114) that is void of cement (116) is determined using the scanner (204) (S302). The scanner (204) takes measurements of the casing string (108) and sends a plurality of signals from the scanner (204) to a computer processor (222) at a surface location using the wired tubing (202).

The signals may include the measurements, such as acoustic measurements, taken by the scanner (204). The measurements may be used to build a cement bond log. The cement bond log may be analyzed by a person, or a computer program stored on the computer processor (222), to determine where there is a lack of cement (116) behind the casing string (108) in the annulus (114). When the portion (118) of the annulus (114) that is void of cement (116) is determined, the i-DPIS system (200) may be moved within the casing string (108) to align the perforating arms (208) with the downhole-most section of the portion (118) of the annulus (114) void of cement (116).

The packer (206) is activated to isolate a downhole section (214) of the casing string (108) from an up-hole section (216) of the casing string (108) (S304). The packer (206) is activated by pumping a fluid (210) into the conduit (212) of the wired tubing (202). A first pressure is applied by the fluid (210) to the packer (206) to activate the packer (206). Activating the packer (206) includes moving the packer (206) from an unexpanded position to an expanded position. The expanded position presses the packer (206) against the inner surface (110) of the casing string (108)

A plurality of holes (218) are punched into the up-hole section (216) of the casing string (108) by ejecting the perforating arms (208) from the wired tubing (202) (S306). The perforating arms (208) are ejected from the wired tubing (202) by applying a second pressure to a plurality of shear pins (224) that are holding the perforating arms (208) in place within the wired tubing (202). The second pressure is greater than the first pressure and the second pressure breaks the shear pins (224). With the shear pins (224) broken, springs located in the perforating arms (208) are provide the power needed to eject the perforating arms (208) from the wired tubing (202) and through the wall of the casing string (108).

The perforating arms (208) are retracted back into the wired tubing (202) by applying a weight to the wired tubing (202) from the surface location. The downhole movement of the wired tubing (202) causes the perforating arms (208) to bend within the holes (218) of the casing string (108) which triggers the perforating arms (208) to retract back into the wired tubing (202). The perforating arms (208) are prevented from being re-ejected from the wired tubing (202) by a locking mechanism located within the body (220) of the wired tubing (202).

The annulus (114) of the casing string (108) is cemented by pumping cement (116) through the plurality of holes (218) into the portion (118) of the annulus (114) void of cement (116) (S308). Specifically, the cement (116) is pumped from the surface location, into the conduit (212) of the wired tubing (202), out of the hollow perforating arms (208), through the holes (218) in the casing string (108), and into the annulus (114) of the casing string (108). In accordance with one or more embodiments, a spacer fluid, such as water, may be pumped into the annulus (114), prior to the cement (116), in order to flush out any fluid or debris located in the annulus (114).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for cementing an annulus of a casing string, the method comprising:

running a wired tubing having perforating arms, a packer, and a scanner into the casing string, wherein the packer has a solid body;

determining a portion of the annulus that is void of cement using the scanner;

activating the packer to isolate a downhole section of a conduit of the casing string from an up-hole section of the conduit of the casing string, wherein the downhole section includes a portion of the annulus that has cement, and the up-hole section includes the portion of the annulus that is void of cement;

punching a plurality of holes in the up-hole section of the casing string by ejecting the perforating arms from the wired tubing, wherein the plurality of holes are located up-hole from the packer; and cementing the annulus of the casing string by pumping cement through the plurality of holes into the portion of the annulus void of cement.

2. The method of claim 1, wherein determining the portion of the annulus that is void of cement using the scanner further comprises sending a plurality of signals from the scanner to a computer processor at a surface using the wired tubing.

3. The method of claim 1, further comprising aligning the perforating arms with the portion of the annulus that is void of cement prior to activating the packer.

4. The method of claim 1, wherein activating the packer further comprises pumping a fluid into a conduit of the wired tubing.

5. The method of claim 4, wherein pumping the fluid into the conduit of the wired tubing further comprises applying a first pressure on the packer to activate the packer.

6. The method of claim 5, wherein ejecting the perforating arms from the wired tubing further comprises applying a second pressure to the perforating arms.

7. The method of claim 6, wherein applying the second pressure to the perforating arms further comprises breaking a plurality of shear pins holding the perforating arms in place.

8. The method of claim 7, further comprising retracting the perforating arms into the wired tubing.

9. The method of claim 8, wherein retracting the perforating arms into the wired tubing further comprises applying a weight to the wired tubing from a surface location.

10. The method of claim 1, wherein cementing the annulus of the casing string by pumping cement through the plurality of holes in the casing string further comprises pumping cement out of the wired tubing using the perforating arms.

11. A system for cementing an annulus of a casing string, the system comprising:

a wired tubing disposed within the casing string;

a scanner electronically and physically connected to the wired tubing, wherein the scanner is configured to detect a portion of the annulus that is void of cement;

a packer having a solid body, an unexpanded position, and an expanded position and connected to the wired tubing, wherein the expanded position of the packer isolates a downhole section of a conduit of the casing string from an up-hole section of the conduit of the casing string and wherein the downhole section includes a portion of the annulus that has cement and the up-hole section includes the portion of the annulus that is void of cement;

perforating arms, having an ejected position and a retracted position, connected to the wired tubing;

a plurality of holes in the casing string created by the perforating arms moving from the retracted position to the ejected position, wherein the plurality of holes are located up hole from the packer; and cement configured to be pumped from a surface location, through a conduit of the wired tubing, and into the portion of the annulus that is void of cement using the plurality of holes.

12. The system of claim 11, further comprising a computer processor located at the surface location and electronically connected to the wired tubing.

13. The system of claim 12, wherein the computer processor is configured to receive a plurality of signals from the scanner using the wired tubing.

14. The system of claim 11, wherein the packer moves from the unexpanded position to the expanded position by application of a first pressure on the packer using a fluid.

15. The system of claim 14, wherein the perforating arms are held in place within the wired tubing using a plurality of shear pins configured to be broken under a second pressure.

16. The system of claim 15, wherein the perforating arms move from the retracted position to the ejected position by applying the second pressure to the shear pins using the fluid.

17. The system of claim 16, wherein the perforating arms move from the ejected position to the retracted position by applying a weight to the wired tubing from the surface location.

18. The system of claim 11, wherein the perforating arms comprise a plurality of springs.

19. The system of claim 11, wherein the perforating arms are hollow and hydraulically connected to the conduit of the wired tubing and the annulus of the casing string using the plurality of holes.

20. The system of claim 19, wherein the cement is configured to be pumped through the plurality of holes into the portion of the annulus that is void of cement using the perforating arms.

* * * * *